US012129620B1

(12) United States Patent
Zeng et al.

(10) Patent No.: US 12,129,620 B1
(45) Date of Patent: Oct. 29, 2024

(54) METHOD FOR REPAIRING AQUIFER IN COAL MINE AREA

(71) Applicant: CHINA UNIVERSITY OF MINING AND TECHNOLOGY, BEIJING, Beijing (CN)

(72) Inventors: Yifan Zeng, Beijing (CN); Weihong Yang, Beijing (CN); Qiang Wu, Beijing (CN); Kai Pang, Beijing (CN); Xinjiang Wei, Beijing (CN); Xue Liu, Beijing (CN); Xuan Xiao, Beijing (CN); Aoshuang Mei, Beijing (CN); Shihao Meng, Beijing (CN); Chao Yu, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/600,416

(22) Filed: Mar. 8, 2024

(30) Foreign Application Priority Data

Dec. 21, 2023 (CN) ..... 202311774997.1

(51) Int. Cl.
*E21B 33/13* (2006.01)
*E02D 3/12* (2006.01)

(52) U.S. Cl.
CPC ..... *E02D 3/12* (2013.01); *E02D 2250/003* (2013.01); *E21B 33/13* (2013.01)

(58) Field of Classification Search
CPC ..... E21C 41/18; E02D 3/12; E02D 2250/003
See application file for complete search history.

(56) References Cited

U.S. PATENT DOCUMENTS 11,459,849 B1 * 10/2022 Zeng ..... E21B 27/00
11,781,429 B1 * 10/2023 Zeng ..... E21B 33/13 299/11

FOREIGN PATENT DOCUMENTS

| | | | |
|---|---|---|---|
| CN | 108999634 | A | 12/2018 |
| CN | 115419384 | A | 12/2022 |
| CN | 115614055 | A | 1/2023 |
| CN | 115829398 | A | 3/2023 |
| WO | 2020192055 | A1 | 10/2020 |

OTHER PUBLICATIONS

First Office Action issued in counterpart Chinese Patent Application No. 202311774997.1, dated May 15, 2024.
Guan et al., Optimal Application of Advance Pre-grouting Technology to High-pressure Water-rich Karst Tunnel, Tunnel Construction, 2018, 38, pp. 136-141, dated Jun. 30, 2018.

* cited by examiner

*Primary Examiner* — Carib A Oquendo
(74) *Attorney, Agent, or Firm* — Westbridge IP LLC

(57) ABSTRACT

Disclosed is a method for repairing an aquifer in a coal mine area by grouting, including: drilling a survey hole in a ground area corresponding to a water inflow position from ground surface to a caving zone in a goaf; determining a target layer for grouting in the survey hole based on drilling data collected from the survey hole while drilling; changing the survey hole to a grouting hole; measuring a first water level from the grouting hole; grouting through the grouting hole; changing the grouting hole to an observation hole; measuring a second water level from the observation hole; and determining a water retention level based on the first water level and the second water level.

7 Claims, 5 Drawing Sheets

METHOD FOR REPAIRING AQUIFER IN COAL MINE AREA

CROSS-REFERENCE TO RELATED APPLICATIONS

This application claims priority to Chinese Patent Application No. 202311774997.1, filed on Dec. 21, 2023, the content of which is incorporated herein by reference in its entirety.

TECHNICAL FIELD

The present disclosure relates to a technical field of water retention of aquifers, in particular to a method for repairing an aquifer in a coal mine area.

BACKGROUND

Coal is an important natural resource. With more and more coal mining and utilizations, numerous goaf areas have been formed underground, and a large amount of continuous roof water inrush has occurred in the goaf areas, which cause serious losses of shallow water resources. Currently, grouting is a most commonly used method to maintain a stability of aquifers. A key issue is how to grout accurately to seal roof water inrush channels.

In conventional methods, in order to grout and repair the aquifers accurately for water retention, multiple types of boreholes are required to be drilled in a ground area. These multiple types of boreholes may include survey holes, grouting holes and observation holes. However, drilling a large number of boreholes in the ground area may damage formations underground and pollute the environment. Moreover, in these conventional solutions, the boreholes are not fully utilized and the production and maintenance costs of these boreholes are also quite high. In view of the above, there is an urgent need for a method of an aquifer reparation in a coal mine to realize water retentions of the aquifer.

SUMMARY

In view of the above, the present disclosure provides a method for repairing an aquifer in a coal mine area. In this method, one or more boreholes with multiple functions can be utilized for grouting to solve the problems mentioned above.

The method for repairing an aquifer in a coal mine area may include: drilling a survey hole from ground surface to a caving zone in a goaf in a ground area corresponding to a water inflow position; determining a target layer for grouting based on drilling data collected from the survey hole while drilling; changing the survey hole to a grouting hole; measuring a first water level from the grouting hole; grouting through the grouting hole; changing the grouting hole to an observation hole after grouting; measuring a second water level from the observation hole; and determining a water retention level of the target layer based on the first water level and the second water level.

As described above, in the method for repairing an aquifer in a coal mine area, a survey hole is first drilled in a ground area corresponding to a water inflow position from the ground surface to a caving zone in a goaf. Then, a target layer for grouting is determined based on drilling data collected from the survey hole while drilling. Later, the survey hole is changed to a grouting hole. From the grouting hole, a first water level is measured. Moreover, grouting is performed through the grouting hole. The grouting hole is then changed to an observation hole. Further, a second water level is measured from the observation hole. At last, a water retention level of the target layer is determined based on the first water level and the second water level.

In can be seen from the above description, in the method disclosed, one or more boreholes with multiple functions can be drilled and fully utilized as a survey hole, a grouting hole and an observation hole. Therefore, there is no need to dill boreholes with different functions separately. In this case, the formations underground and the environment can be protected. Further, the costs for production and maintenance of the boreholes can also be greatly reduced. Moreover, the method disclosed can realize water retentions in aquifers in a coal mine area in a simple way. By this method, the loss of shallow water resources can be reduced effectively and the stability of the aquifers can also be maintained.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

Coal is an important natural resource. With more and more coal mining and utilization, numerous goaf areas have been formed underground, and a large amount of continuous roof water inrush has occurred in the goaf areas, causing serious losses of shallow water resources. Currently, grouting is a most commonly used technical method to maintain a stability of aquifers. A key issue is how to grout accurately to achieve an effective sealing of roof water inrush channels. In conventional methods, in order to grout and repair the aquifers accurately for water retention, multiple types of boreholes are required to be drilled in the ground area. These multiple types of boreholes may include survey holes, grouting holes and observation holes. Specifically, a survey hole is used to collect geological information; a grouting hole is used for grouting; and an observation hole is used to monitor water level changes before and after grouting and to determine the water retention level. However, drilling a large number of boreholes in the ground area may damage formations and pollute the environment. Moreover, the boreholes are not fully utilized in these conventional solutions and the production and maintenance costs of these boreholes are also quite high. In view of the above, there is an urgent need for a method for repairing an aquifer in a coal mine to realize the water retention.

In the following, a technical solution of the method for repairing an aquifer in a coal mine will be further explained in detail through specific examples and FIGS. 1 to 7.

Figure 1:
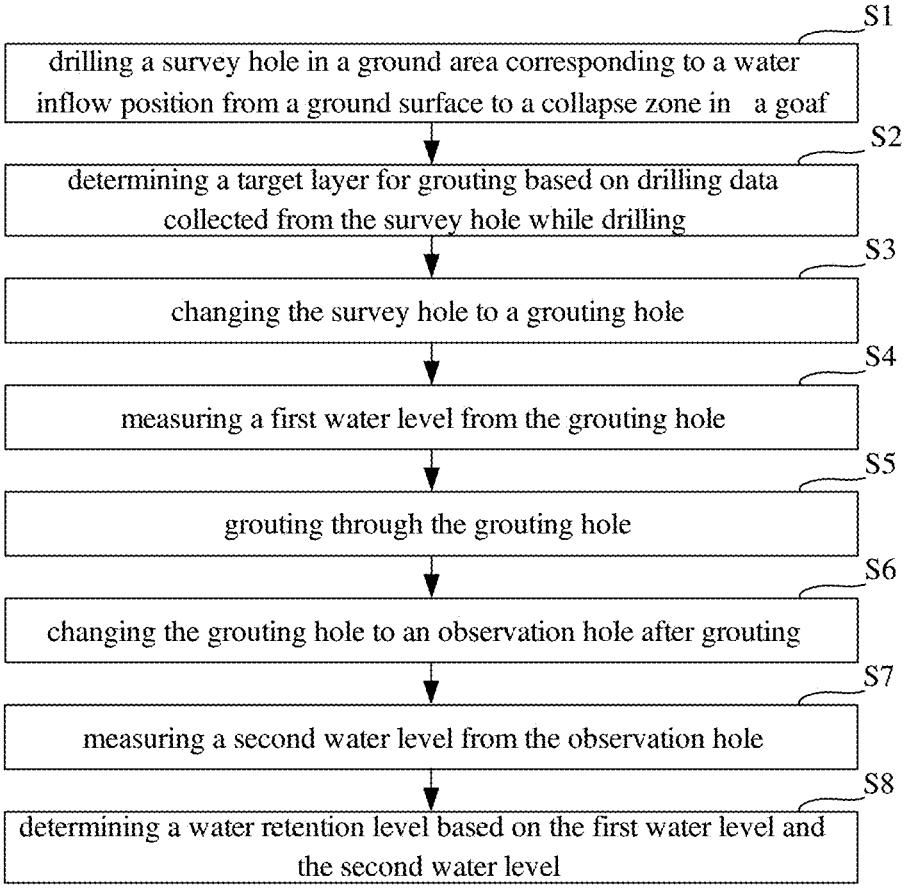
FIG. 1 is a schematic diagram of a method for repairing an aquifer in a coal mine area according to examples of the present disclosure.

FIG. 1 is a schematic diagram illustrating a method for repairing an aquifer in a coal mine area according to examples of the present disclosure. As shown in FIG. 1, the method may include the following steps.

In S1, drilling a survey hole in a ground area corresponding to a water inflow position from a ground surface to a caving zone in a goaf.

In examples of the present disclosure, the ground area corresponding to the water inflow position can be determined based on water inflow data. For example, the water inflow data may include at least one of a water inflow volume, a water level, a water pressure and etc. The water inflow data of a water inflow point of a sealed wall in an underground tunnel can be obtained. Then, distributions of underground water inflow filling channels and distributions of water rich areas in aquifers can be determined based on the water inflow data combined with a development of rock fractures and results of water rich geophysical exploration of the roof. Finally, the ground area corresponding to the water inflow position can be determined. For example, an area right above the water inflow point can be determined as the ground area.

In some examples of the present disclosure, multiple survey holes would be drilled in the ground area. In this case, after determining the ground area, distributions of the multiple survey holes should be determined. Further, since in the method disclosed, a survey hole would be reused as a grouting hole in subsequent steps, there would be multiple grouting holes in the ground area and the distributions of the survey holes should be the same with the distributions of the grouting holes. Therefore, the distributions of the survey holes would be determined based on the distributions of the grouting holes.

Moreover, in some examples of the present disclosure, the distributions of the grouting holes would be determined based on a diffusion range of a grouting hole and a layout requirement of the grouting holes. In some examples, a diffusion range of a grouting hole may be a circular range with a radius of 20 meters (m) centered on the grouting hole. The layout requirement of the grouting holes is that the diffusion ranges of all the grouting holes should cover the ground area. It can be seen that, based on the diffusion range of each grouting hole and the layout requirement of the grunting holes, the distributions of the grouting holes would be determined. As stated above, the distributions of the grouting holes are the same with the distributions of the survey holes. Therefore the distributions of the survey holes would be determined. That is, the positions where to drill the survey holes in step S1 can be determined.

Figure 6:
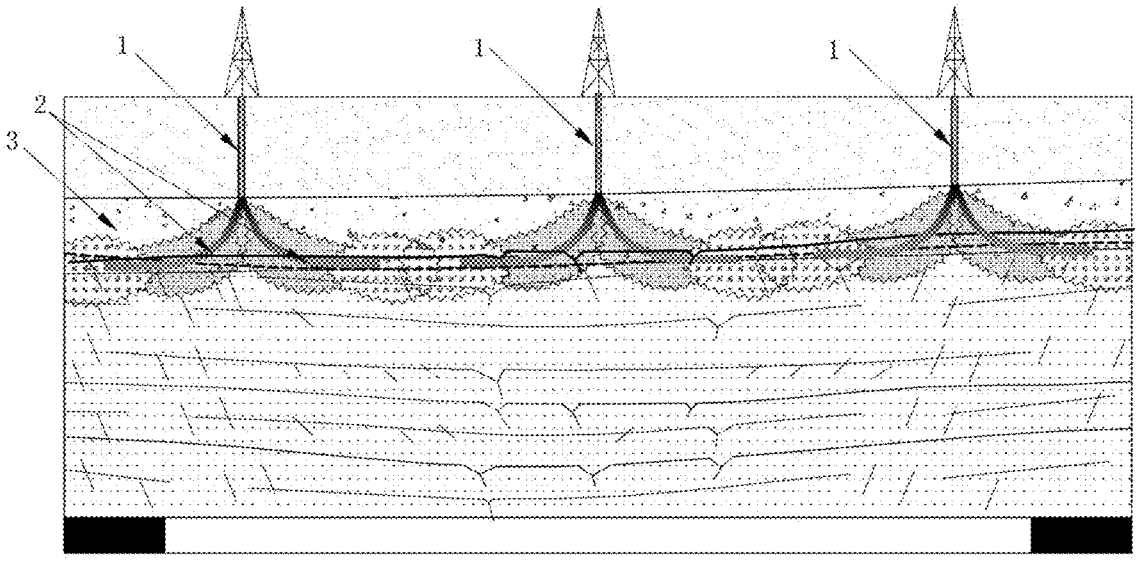
FIG. 6 is a cross-sectional view of a grouting hole according to some examples of the present disclosure.

In other examples, as shown in FIG. 6, multiple branch holes can be further obtained by drilling multiple horizontal branches outward from a vertical grouting hole. In these examples, the length of each branch hole can be 20 m. Therefore, a diffusion radius of a grouting hole can be expanded to 30 m. Further, the layout requirement of the grouting holes is that the diffusion ranges of any two adjacent grouting holes should overlap by 20 m, and the diffusion ranges of all the grouting holes should cover the ground area. In this case, the distributions of the grouting holes can be determined according to the diffusion range of each grouting hole and the layout requirement of the grunting holes. Therefore, the positions where to drill the survey holes in step S1 can be determined.

After determining the positions of the survey holes, the survey holes can be drilled downwards from the ground surface. For each survey hole, when a caving zone is reached, the drilling process can be stopped. In examples of the present disclosure, an amount of drilling fluid leakage during the drilling process can be monitored in real time. When a full drilling fluid leakage is detected according to the amount of the drilling fluid leakage, it indicates that the survey hole has reached the caving zone. In this case, no further drilling is needed. Thus, in examples of the present disclosure, the survey hole can be used to collect information of each rock layer in the survey hole, providing a basis for determining the target layer in a subsequent step.

In S2, determining a target layer for grouting based on drilling data collected from the survey hole while drilling.

During the drilling process, drilling data can be collected through the survey hole(s) in real time. According to examples of the present disclosure, the drilling data collected may include a drilling fluid leakage rate, a rock core sampling rate, and/or a fracture density. Based on the drilling data, the target layer for grouting can be determined. In examples of the present disclosure, the target layer may refer to an aquifer that needs to be grouted. For the purpose of water retention, a rock layer with the following two characters should be selected as the target layer. First, the rock layer should have relatively well-developed fractures. Second, there are no large number of penetrating fractures in both its upper layer (also called its previous layer) and its lower layer (also called its subsequent layer). This selection rule can utilize the water resistance function of both its upper layer and its lower layer. In this way, a goal of blocking water in overall fractured rock layers after mining can be achieved by grouting the target layer only. In some examples, a total depth of an aquifer, for example, can be 20 m.

In S3, changing the survey hole to a grouting hole.

In some examples of the present disclosure, by changing the survey hole into a grouting hole, a survey hole can be reused as a grouting hole while grouting the aquifer, that is, the target layer. That is to say, in the method disclosed, there is no need to set up a survey hole and a grouting hole separately in the ground area. Therefore, a utilization rate of any borehole drilled can be improved. Moreover, formations underground and the environment can be protected effectively.

In some examples of the present disclosure, the method of changing the survey hole to a grouting hole may include: sealing the survey hole with cement slurry at first; and drilling the grouting hole at the place of the survey hole to the target layer. In these examples, an aperture of the grouting hole is larger than that of the survey hole. In some examples, the survey hole can be sealed partially or completely and then be expanded by drilling to form the grouting hole.

In S4, measuring a first water level from the grouting hole.

In examples of the present disclosure, the first water level before grouting can be measured from the grouting hole. In a subsequent step, a judgment on a result of the grouting can be made based on the first water level measured.

In S5, grouting through the grouting hole.

As stated above, the grouting hole can be used for grouting. Therefore, a grouting process can be performed directly through the grouting hole.

In S6, changing the grouting hole to an observation hole after grouting.

Moreover, after grouting, a filter pipe can be inserted into the grouting hole; and then an observation sleeve can be inserted into the filter pipe to form an observation hole. In this way, a grouting hole can be reused as an observation hole in the following process.

In S7, measuring a second water level from the observation hole.

In some examples of the present disclosure, a water level observer can be set at a hole mouth of the observation hole to monitor changes in water levels in real time. Therefore, through the water level observer, the second water level can be measured from the observation hole. To be noted, the second water level refers to a water level after grouting.

It can be seen that in the method disclosed, the grouting hole can be reused as the observation hole. Therefore, there is no need to set up any separate observation holes in the ground area to monitor the water levels. In this way, the utilization rate of the boreholes can be further improved. Moreover, formations underground and the environment can be protected effectively.

In S8, determining a water retention level based on the first water level and the second water level.

In this step, if there is a significant increase in the water level after grouting in the borehole compared to the water level before grouting, and the water level remains stable in a following preset time period, it indicates that the grouting process has achieved an expected effect and the water retention level may be determined as an effective water retention. However, if the water level rises after grouting in the borehole but then drops to the water level before grouting, it indicates that the grouting process has not achieved the expected effect and the water retention level may be determined as an ineffective water retention.

It can be seen from the method disclosed, a borehole with multiple functions can be drilled and fully utilized as a survey hole, a grouting hole and an observation hole. There is no need to drill separate survey holes, grouting holes or observation holes in the ground area. Therefore, the formations underground and the environment can be protected. Further, the costs for production and maintenance of boreholes can also be greatly reduced. Moreover, the method disclosed can realize water retentions in aquifers in a coal mine area in a simple way. By this method, the loss of shallow water resources can be reduced effectively and the stability of the aquifers can also be maintained.

In the following, detailed descriptions would be given in respect to each step of the method disclosed.

With respect to step S2, in some examples, the drilling data may include a drilling fluid leakage rate. In this case, step S2 may include the following steps: monitoring the drilling fluid leakage rate at each layer from the survey hole in real time during the drilling process; in response to determining the drilling fluid leakage rate corresponding to a certain layer is greater than 70% and the drilling fluid leakage rates corresponding to its upper layer and its lower layer are both less than 30%, determining that the certain layer is the target layer.

Figure 4:
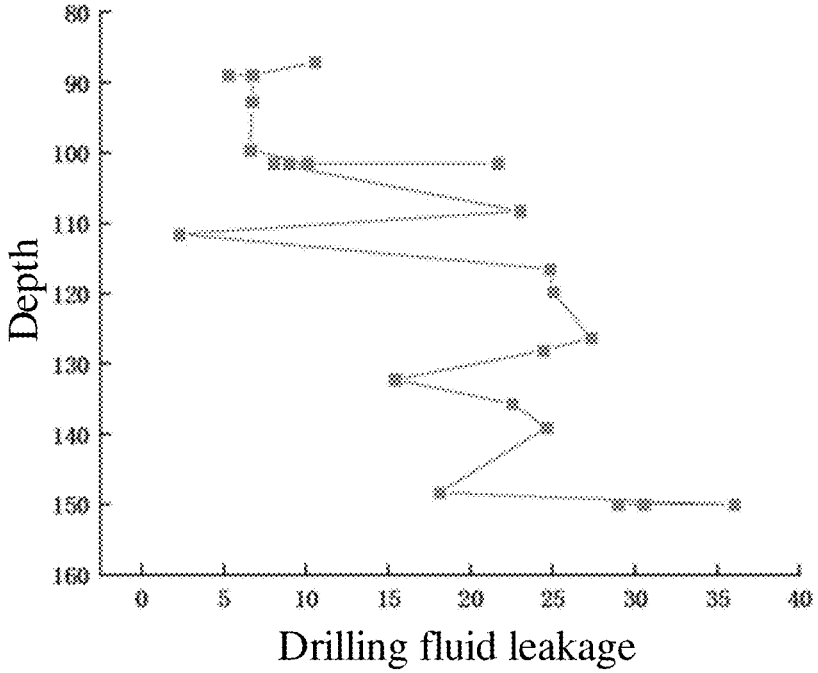
FIG. 4 is a schematic diagram of changes in the drilling fluid leakage during the drilling process of the survey hole according to some examples of the present disclosure.

During the drilling process of the survey hole, a slurry tank and a return slurry tank can be set up separately. The slurry tank is used to hold the drilling fluid. During the drilling process, a usage amount of the drilling fluid and a leakage amount of the drilling fluid are recorded in real time. The leakage amount of the drilling fluid can be obtained based on a corresponding relationship between a difference between a slurry height in the return slurry tank and an expected slurry height and a leakage amount of the drilling fluid. The lower the slurry height in the return slurry tank, the greater the leakage amount of the drilling fluid. Further, the drilling fluid leakage rate can be calculated by dividing the leakage amount of the drilling fluid by the usage amount of the drilling fluid. By the method described above, the drilling fluid leakage rate at each layer of the survey hole can be monitored in real time. Moreover, if the drilling fluid leakage rate at a specific rock layer is greater than 70%, it indicates that this specific rock layer is severely fractured. Further, if the drilling fluid leakage rates corresponding to its upper layer and its lower layer are both less than 30%, it indicates that the upper layer and the lower layer of this specific rock layer are relatively intact. Therefore, this specific rock layer can be regarded as the target layer. As shown in FIG. 4, the usage amount of the drilling fluid is about 30 $m^3/h$. Moreover, according to the above rules, the depth of the target layer is about 110 m.

In some other examples, the drilling data may include a core sampling rate. In this case, step S2 may include the following steps: monitoring the core sampling rate at each layer from the survey hole in real time during the drilling process; in response to determining the core sampling rate corresponding to a certain layer is less than 40% and the core sampling rates corresponding to its upper layer and its lower layer are both greater than 70%, determining that the certain layer is the target layer.

Figure 2:
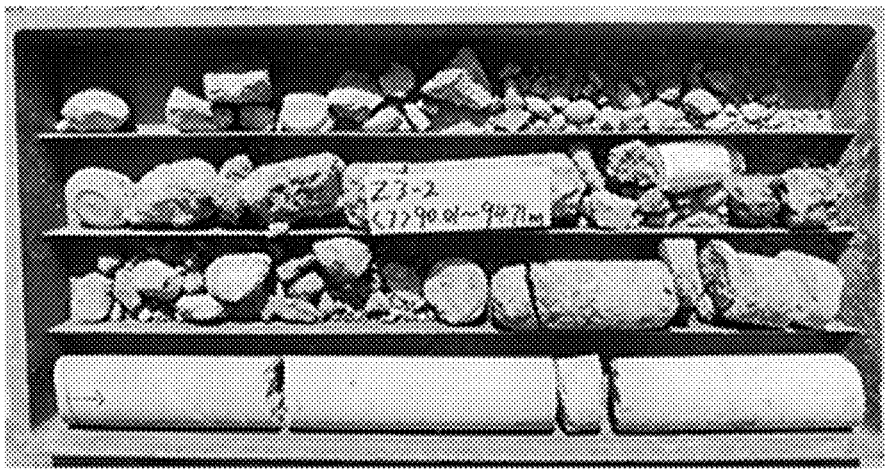
FIG. 2 is a schematic diagram of rock core samplings extracted from a survey hole with a depth ranging from 90.01 m to 94.71 m according to some examples of the present disclosure.
Figure 3:
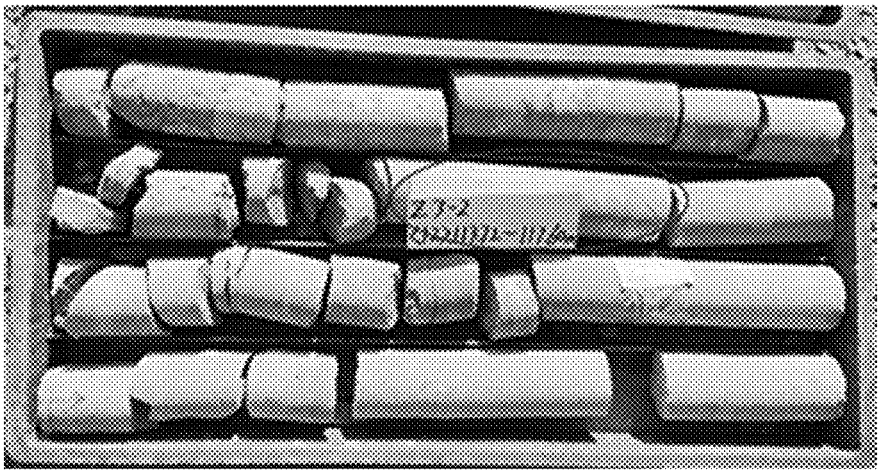
FIG. 3 is a schematic diagram of rock core samplings extracted from a survey hole with a depth ranging from 113.72 m to 117.60 m according to some examples of the present disclosure.

During the drilling process of the survey hole, core samplings at different depths can also be carried out, as shown in FIGS. 2 and 3. Then, the core sampling rate of different layers can be calculated based on an integrity of samples of the core. The more complete the rock layer, the higher the core sampling rate. During the drilling process, the core sampling rate for each layer in the survey hole can be monitored in real time. Moreover, if the core sampling rate of a specific rock layer is less than 40%, it indicates that the specific rock layer is severely fractured. Further, if the core sampling rates of its upper layer and its lower layer are both greater than 70%, it indicates that the upper layer and the lower layer of this specific rock layer are relatively intact. Therefore, this specific rock layer can be regarded as the target layer.

In still other examples, the drilling data may include a fracture density. In this case, step S2 may include the following steps: monitoring the fracture density at each layer in the survey hole in real time during the drilling process; in response to determining the fracture density corresponding to a certain layer is greater than 40% and the fracture densities corresponding to its upper layer and its lower layer are both less than 10%, determining that the certain layer is the target layer.

Figure 5:
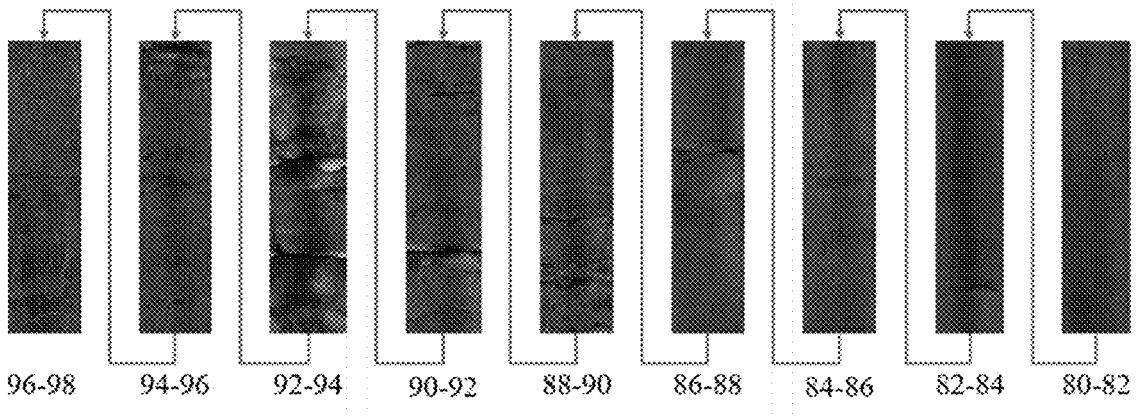
FIG. 5 is a visualized diagram of fractures extracted from a survey hole with a depth ranging from 80 m to 98 m according to some examples of the present disclosure.

During the drilling process of the survey hole, as shown in FIG. 5, a real-time drilling television can also be used to show fractures at different depths. In this way, the fracture density can be calculated based on the number of fractures in the rock layer. During the drilling process, the fracture density of each layer in the survey hole can be monitored in real time. If the fracture density of a specific rock layer is greater than 40%, it indicates that the rock layer is severely fractured. Further, if the fracture densities of its upper layer and its lower layer are both less than 10%, it indicates that the upper layer and the lower layer of this specific rock layer are relatively intact. Therefore, this specific rock layer can be regarded as the target layer.

Figure 8:
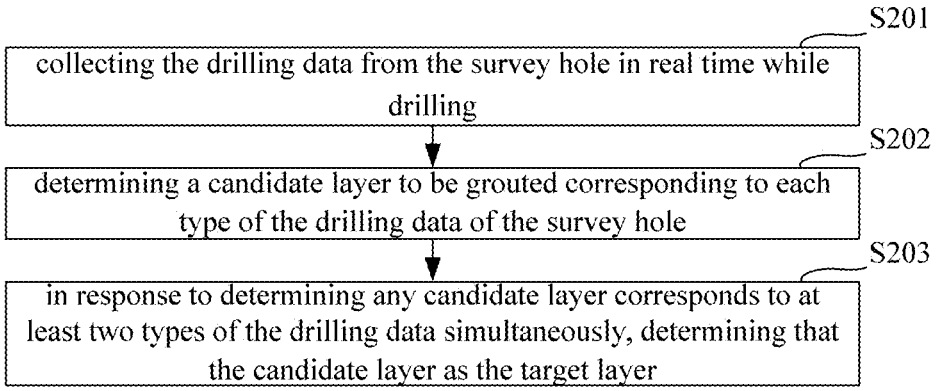
FIG. 8 is a schematic diagram of the method for determining a target layer for grouting based on drilling data collected from the survey hole while drilling according to some examples of the present disclosure.

In the above method, the target layer can be determined based on one type of drilling data. In other examples, the target layer can also be determined based on multiple types of drilling data. Specifically, in these examples, as shown in FIG. 8, step S2 may include the following steps.

In S201, collecting the drilling data from the survey hole in real time while drilling.

In S202, determining a candidate layer to be grouted corresponding to each type of the drilling data of the survey hole.

As described above, the drilling data may include any of the drilling fluid leakage rate, the core sampling rate and the fracture density. In this case, step S202 may include the following steps.

Monitoring the drilling fluid leakage rate at each layer from the survey hole in real time during the drilling process; in response to determining the drilling fluid leakage rate corresponding to a certain layer is greater than 70% and the drilling fluid leakage rates corresponding to its upper layer and its lower layer are both less than 30%, determining that the certain layer is a candidate layer to be grouted.

Monitoring the core sampling rate at each layer from the survey hole in real time during the drilling process; in response to determining the core sampling rate corresponding to a certain layer is less than 40% and the core sampling rates corresponding to its upper layer and its lower layer are both greater than 70%, determining that the certain layer is a candidate layer to be grouted.

Monitoring the fracture density at each layer from the survey hole in real time during the drilling process; in response to determining the fracture density corresponding to a certain layer is greater than 40% and the fracture densities corresponding to its upper layer and its lower layer are both less than 10%, determining that the certain layer is a candidate layer to be grouted.

In this way, for each type of the drilling data, a candidate layer to be grouted can be determined.

In S203, in response to determining any candidate layer corresponds to at least two types of the drilling data simultaneously, determining that the candidate layer as the target layer.

By monitoring various types of drilling data collected from the survey hole, and selecting at least two types of drilling data to determine the target layer, the accuracy of grouting can be further improved and the effect of water retention can also be further improved.

Figure 9:
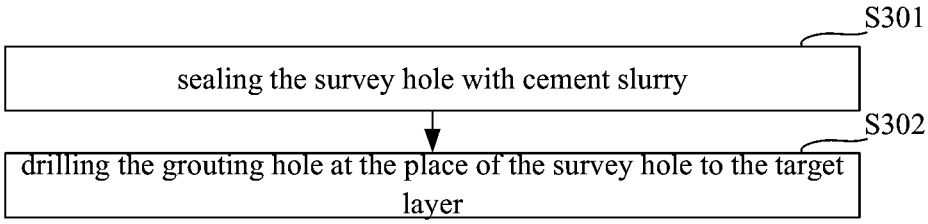
FIG. 9 is a schematic diagram of the method for changing the survey hole to a grouting hole according to some examples of the present disclosure.

In some examples of the present disclosure, as shown in FIG. 9, in S3, the step of changing the survey hole to a grouting hole may include the following steps.

In S301, sealing the survey hole with cement slurry.

In some examples, the sealing process can be achieved through a complete sealing, which is more convenient to operate. The grouting method can be used at the orifice to calculate a required volume for grouting the entire borehole. To be noted, an excess coefficient of 1.2 can be used while calculating the required volume. A grouting pressure about 1 MPa can be used for grouting. In some other examples, a partial sealing can also be used. In the partial sealing process, sealing above the target layer is sufficient for subsequent drilling of the grouting hole.

In S302, drilling the grouting hole at the place of the survey hole to the target layer; where, an aperture of the grouting hole is larger than that of the survey hole.

In some examples of the present disclosure, a diameter of the survey hole can be 133 mm, and a diameter of the grouting hole can be 215 mm.

In step S302, a grouting hole can be obtained by drilling a borehole at the place of a sealed survey hole from the ground surface to the target layer. At this time, a drill bit used can conduct a downward detection without drilling, such as at 0.3 MPa. In response to determining that the drill bit can continue to move downward, it means that the target layer is not completely sealed. In this case, an additional seal of the survey hole needs to be conducted before drilling a grouting hole. In response to determining that the drill bit cannot continue to move downward, it indicates that the target layer is completely sealed. After drilling the grouting hole, a grouting sleeve can be inserted into the grouting hole to ensure a stability of the grouting hole and prevent a collapse of the borehole.

Figure 10:
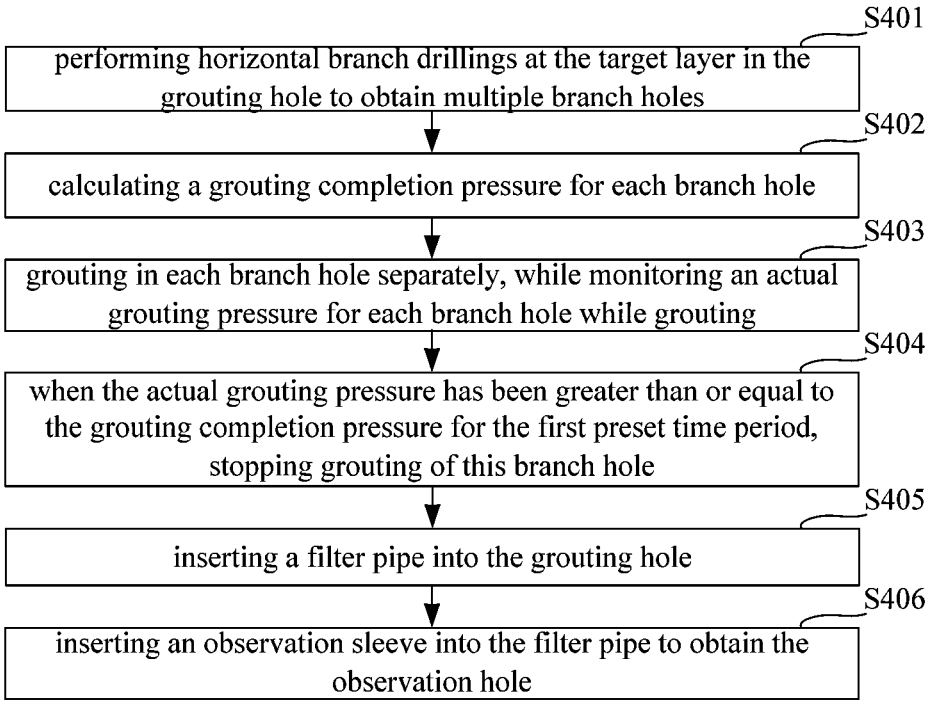
FIG. 10 is a schematic diagram of the method for grouting through the grouting hole according to some examples of the present disclosure.

In some examples, as shown in FIG. 10, the step of grouting through the grouting hole in S5 may further include the following steps.

In S401, performing horizontal branch drillings at the target layer in the grouting hole to obtain multiple branch holes.

As shown in FIG. 6, the horizontal branch drillings can be performed by a flexible drilling tool. Through the horizontal branch drillings performed by the flexible drilling tool, multiple branch holes may be obtained in the target layer. For example, one grouting hole may have 3 or 4 branch holes to expand its grouting range. To be noted, the number of branch holes of each grouting hole is not limited by the present disclosure.

In S402, calculating a grouting completion pressure for each branch hole.

In examples of the present disclosure, the grouting completion pressure should be constrained by the following formula.

$$R = \left[\frac{0.093(P_2 - P_1)tbr^{0.21}}{\mu}\right]^{\frac{1}{221}} + r$$

Here, R refers to a diffusion radius of a slurry, specified in centimeters (cm); t refers to a grouting time, specified in seconds (s); $P_1$ refers to a water pressure of the target layer, specified in Pascals (Pa); $P_2$ refers to the grouting completion pressure, specified in Pa; b refers to a width of the fracture of the target layer, specified in cm; μ refers to a viscosity of the slurry, specified in cm Pa*s; and r refers to a radius of a branch hole, specified in cm.

In some other examples, the grouting completion pressure can also be calculated according to experiences, for example, according to the following formula.

$$p \geq \frac{2H\gamma}{100} + (1 \sim 3)$$

Here, in the above formula, ρ refers to the grouting completion pressure, whose range is usually about 2.5 MPa-4.0 MPa; H refers a depth of the grouting hole; γ refers to an adjust coefficient.

In S403, grouting in each branch hole separately, while monitoring an actual grouting pressure for each branch hole while grouting.

In S404, for each branch hole, in response to determining the actual grouting pressure has been greater than or equal to the grouting completion pressure for a first preset time period, stopping grouting in this branch hole.

In some examples of the present disclosure, the first preset time period may be set based on experiences, for example, 30 minutes. To be noted, the duration of the first preset time period is not limited in examples of the present disclosure.

In step S404, when the actual grouting pressure has been greater than or equal to the grouting completion pressure for the first preset time period, it indicates that the grouting of this branch hole completed. Therefore, the grouting process in this branch hole can be stopped.

In some examples, the step of changing the grouting hole to an observation hole in S6 may include the following steps.

In S405, inserting a filter pipe into the grouting hole.

In some examples of the present disclosure, the filter pipe is used to filter debris in fractured rock layers and loose strata, purify water, and prevent impurities from blocking the observation casing after grouting. In this way, measurement results of the water level can be more accurate.

In S406, inserting an observation sleeve into the filter pipe to obtain the observation hole.

Figure 11:
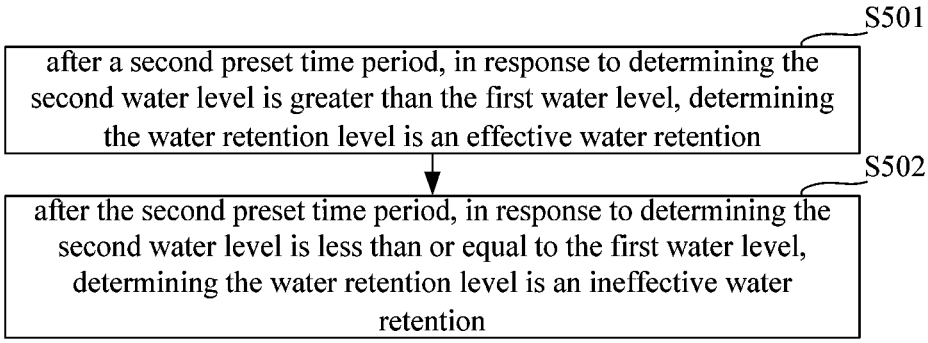
FIG. 11 is a schematic diagram of the method for determining a water retention level based on the first water level and the second water level according to some examples of the present disclosure.

In some examples, as shown in FIG. 11, the step of determining a water retention level based on the first water level and the second water level in S8 may include the following steps.

In S501, after a second preset time period, in response to determining the second water level is greater than the first water level, determining the water retention level is an effective water retention.

In some examples of the present disclosure, the second preset time period may be set based on experiences, for example, half a month. To be noted, the duration of the second preset time period is not limited in examples of the present disclosure. According to step S501, after the second preset time period, if the second water level is still greater than the first water level, it indicates that the grouting process is successful, the water inrush is under control and the water retention is effective.

In S502, after the second preset time period, in response to determining the second water level is less than or equal to the first water level, determining the water retention level is an ineffective water retention.

According to step S502, after the second preset time period, if the second water level is less than or equal to the first water level, it indicates that the grouting process is unsuccessful, the water inrush is not under control and the water retention is not effective. In this case, an additional grouting needs to be performed.

In some examples of the present disclosure, the method for repairing an aquifer in a coal mine area by grouting may further include the following step: in response to determining the water retention level is an ineffective water retention, changing the observation hole to the grouting hole and returning to step S5, that is, grouting through the grouting hole again.

As disclosed, if the water retention level is determined as an ineffective water retention, the observation hole can be changed into a grouting hole and grouting through the grouting hole again. To be noted, before changing the observation hole into a grouting hole, it is necessary to perform a waiting treatment at first. The waiting treatment refers to waiting for 2-4 days to allow the slurry to fully solidify, thus to prevent the slurry injected again from flowing along the initial grouting channel. In this way, a better grouting effect can be achieved. By performing a waiting treatment before step S8 may result in a more accurate judgement result.

According to some examples of the present disclosure, the step of changing the observation hole into a grouting hole may include: removing the observation sleeve and the filter pipe from the observation hole, and inserting a grouting sleeve into the observation hole to form a grouting hole. It can be seen that this procedure is simple and convenient to be performed.

Later, steps S5-S8 are performed again and the water retention level after the additional grouting can be determined.

During the additional grouting process, the flexible drilling tool can be used to open a hole in the middle of previous branch holes. Moreover, grouting can be performed through the hole. When a pressure meets a preset condition, the grouting process of the hole can be stopped.

The method for performing the steps S5-S8 after the additional grouting process is the same as described in the previous step. Therefore, these methods will not be repeated here.

Moreover, if the water retention level is still an ineffective water retention, repeat the operation of changing the observation hole to the grouting hole, and S5-S8 until the water retention level turns to an effective water retention.

In some examples, as shown in FIG. 6, there are multiple grouting holes in the ground area, and a depth difference between the target layers corresponding to two adjacent grouting holes is less than 20 m.

By setting the depth difference between the target layers corresponding to two adjacent grouting holes less than 20 m, the grouting ranges of different grouting holes can be staggered and affect each other. In this way, the grouting effect can be further improved.

In some examples, a following step may be further performed before S8: completing the grouting for all the grouting holes.

Those would understand, after all the grouting work is completed, a better grouting effect may be achieved. In this way, a cost of grouting may be further reduced.

Figure 7:
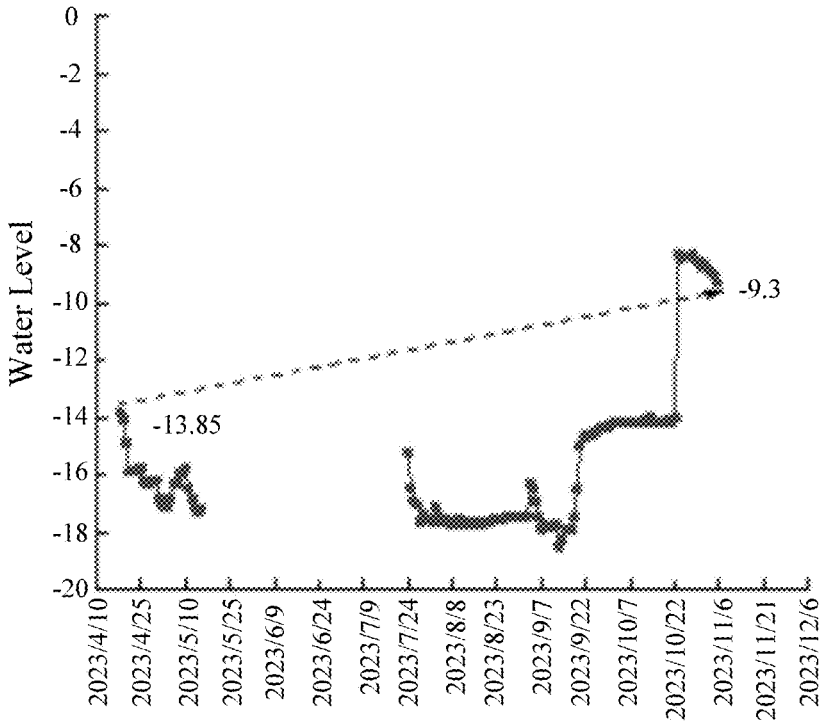
FIG. 7 is a schematic diagram of water levels monitored from a grouting hole before and after grouting according to some examples of the present disclosure.

FIG. 7 is a schematic diagram of water level changes in a grouting hole according to an example of the present disclosure. An interruption of water level changes in FIG. 7 represents the grouting process, during which the water level cannot be monitored. As shown in FIG. 7, the water level before grouting is about −17 m, and after grouting, the water level rises but quickly drops to about −17 m. After grouting through its surrounding grouting holes, the water level in the hole rises to about −15 m and remains stable. In this example, the water lever after grouting is much higher than the water level before grouting. It indicates that the grouting is successful and the water retention is effective.

Taking a coal mine in Shaanxi as an example, after mining in 07 and 09 working faces, it was found that the water discharge from the underground auxiliary cutting hole and the 4900 m advance of the working face were relatively large based on the analysis on the water discharge from the underground sealing wall outlet. Further, it can be determined based on a comprehensive analysis on the overlying rock, the top plate above the cut is the most severely damaged and fractures are fully developed, which is the main concentration area for continuous water inflow underground. Therefore, the cut holes of 07 and 09 working faces are selected as a treatment area.

Then, based on the rules such as, a length of a branch hole can be 20 meters, the slurry can diffuse 20 meters and a 20-meter overlap should be formed between two adjacent grouting holes, a distance between two adjacent grouting holes is designed to be 60 meters, and the final layout of the grouting holes can be determined.

To be noted, the coal seam in this coal mine is relatively shallow, which is about 260 m deep. According to the analysis of the chemical sources of water gushing from the goaf underground, it is known that the main water gushing underground is weathered bedrock water and Quaternary loose layer water. Therefore, it is necessary to grout in the weathered bedrock to achieve the purpose of intercepting and blocking water. Therefore, survey hole can be drilled at the designed drilling points, and the drilling leakage is recorded while drilling. When the drilling leakage continues to be too large, it proves that the drill bit has reached the caving zone and there is no need to continue drilling.

After a comprehensive analysis of drilling fluid leakage, drilling records, the degree of fragmentation of the rock core taken from the survey hole, and geophysical data in the area, it was found that there is an abnormal area in the survey hole at a depth of 110 m, whose water richness is relatively low and the development of fractures is relatively small. Finally, the depth of 110 m was selected as the target layer. Moreover, the first water level (the water level before grouting) was measured as −14.12 m.

Subsequently, multiple branch holes were drilled in the grouting process. Due to the shallow burial depth of the grouting treatment layer, the grouting pressure should not be too high, otherwise it may cause the slurry to return to the ground under high pressure. The grouting completion pressure can be set based on rock properties, hydrogeological characteristics, and empirical values, which is generally 2-3 times the static water pressure. The grouting completion pressure can be set as 2.5 MPa, which can be adjusted according to actual situations.

After a pressure of a branch hole reaches 2.5 mMPa and stabilizes for 0.5 h, the grouting process of this branch hole can be completed. When each branch hole of a grouting hole meets such a pressure, the grouting process of the entire grouting hole can be completed.

The grouting hole then can be changed to an observation hole. That is, the filter pipe and the observation sleeve are inserted according to the softness and depth of the formation. Then, the water level changes inside the grouting layer can be monitored. After half a month, the water level after grouting was measured to be −12.35 m and remained stable. This indicates the water retention is effective.

It is noted that some examples of the present disclosure have been described above. Other examples are within the scope of the following claims. In some cases, the acts or steps recited in the claims may be performed in a different order than in the examples described above and can still achieve desirable results. Additionally, the processes depicted in the accompanying drawings do not necessarily require the particular order shown, or sequential order, to achieve desirable results. In some examples, multi-tasking and parallel processing are also possible or may be advantageous.

Those of ordinary skill in the art should appreciate that the discussion on any one of the foregoing examples is merely exemplary, but is not intended to imply that the scope of the present disclosure (including the claims) is limited to these examples. Under the idea of the present disclosure, the technical features of the foregoing examples or different examples may be combined, the steps may be implemented in any order, and there are many other variations in different aspects of the examples of the present disclosure, all of which are not provided in detail for simplicity.

Besides, for the sake of simplifying description and discussion and not making the examples of the present disclosure difficult to understand, the provided drawings may show or not show the public power supply/earthing connection to an integrated circuit (IC) chip and other parts. Besides, the device may be shown in block diagram form to prevent the examples of the present disclosure from being difficult, and moreover, this considers the following facts, that is, the details of the implementations with regard to the devices in these block diagrams highly depend on the platform which will implement the examples of the present disclosure (that is, these details should be completely within the scope understood by those skilled in the art). Where specific details (e.g. circuits) are set forth in order to describe exemplary examples of the present disclosure, it should be apparent to those skilled in the art that the examples of the present disclosure can be practiced without, or with variation of, these specific details. Therefore, these descriptions shall be considered to be illustrative instead of restrictive thereto.

While the present disclosure has been described in conjunction with specific examples thereof, many alternatives, modifications and variations of such examples will be apparent to those of ordinary skill in the art in light of the foregoing description. The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A water retention method for repairing an aquifer by grouting in a coal mine area after mining based on a hole with multiple uses, comprising:

drilling a survey hole in a ground area corresponding to a water inflow position from ground surface to a caving zone in a goaf;

determining a target layer for grouting based on drilling data collected from the survey hole while drilling, which comprises: monitoring a drilling fluid leakage rate at each layer from the survey hole in real time during the drilling process; in response to determining the drilling fluid leakage rate corresponding to a certain layer is greater than 70% and the drilling fluid leakage rates corresponding to a previous layer and a subsequent layer of the certain layer are both less than 30%, determining that the certain layer is a layer to be grouted; monitoring a core sampling rate at each layer from the survey hole in real time during the drilling process; in response to determining the core sampling rate corresponding to a certain layer is less than 40% and the core sampling rates corresponding to a previous layer and a subsequent layer of the certain layer are both greater than 70%, determining that the certain layer is a layer to be grouted; monitoring a fracture density at each layer from the survey hole in real time during the drilling process; in response to determining the fracture density corresponding to a certain layer is greater than 40% and the fracture densities corresponding to a previous layer and a subsequent layer of the certain layer are both less than 10%, determining that the certain layer is a layer to be grouted; in response to determining a layer is determined as a layer to be grouted corresponds to at least two kinds of the drilling data, determining that the layer is the target layer;

changing the survey hole to a grouting hole; and measuring a water level before grouting from the grouting hole; wherein, changing the survey hole to the grouting hole comprises: sealing the survey hole with cement slurry; and drilling the grouting hole at the place of the survey hole to the target layer; wherein, an aperture of the grouting hole is larger than that of the survey hole;

grouting through the grouting hole; changing the grouting hole to an observation hole after grouting; measuring a water level after grouting from the observation hole;

determining a water retention level based on the water level before grouting and the water level after grouting.

2. The water retention method for repairing an aquifer by grouting in a coal mine area after mining based on a hole with multiple uses according to claim 1, wherein, grouting through the grouting hole comprises:

performing horizontal branch drillings at the target layer to obtain multiple branch holes;

calculate a grouting completion pressure for each branch hole; grouting in each branch hole separately; monitoring an actual grouting pressure for each branch hole while grouting; and for each branch hole, in response to determining the actual grouting pressure has reached the grouting completion pressure for a first preset time period, stopping grouting in the branch hole.

3. The water retention method for repairing an aquifer by grouting in a coal mine area after mining based on a hole with multiple uses according to claim 2, wherein, the grouting completion pressure can be calculated according to the following formula:

$$R = \left[\frac{0.093(P_2 - P_1)tbr^{0.21}}{\mu}\right]^{\frac{1}{221}} + r$$

wherein, R refers to a diffusion radius of a slurry; t refers to a grouting time; $P_1$ refers to a water pressure of the target layer; $P_2$ refers to the grouting completion pressure; b refers to a width of the fracture of the target layer; μ refers to a viscosity of the slurry; and r refers to a radius of a branch hole.

4. The water retention method for repairing an aquifer by grouting in a coal mine area after mining based on a hole with multiple uses according to claim 1, wherein, changing the grouting hole to an observation hole comprises:

inserting a filter pipe into the grouting hole; and inserting an observation sleeve into the filter pipe to obtain the observation hole.

5. The water retention method for repairing an aquifer by grouting in a coal mine area after mining based on a hole with multiple uses according to claim 1, wherein, determining a water retention level based on the water level before grouting and the water level after grouting comprises:

after a second preset time period, in response to determining the water level after grouting is greater than the water level before grouting, determining the water retention level is an effective water retention; or after the second preset time period, in response to determining the water level after grouting is less than or equal to the water level before grouting, determining the water retention level is an ineffective water retention.

6. The water retention method for repairing an aquifer by grouting in a coal mine area after mining based on a hole with multiple uses according to claim 5, further comprising:

in response to determining the water retention level is the ineffective water retention, changing the observation hole to the grouting hole;

grouting through the grouting hole;

changing the grouting hole to the observation hole after grouting; measuring a water level after grouting from the observation hole;

determining a water retention level again based on the water level before grouting and the water level after grouting.

7. The water retention method for repairing an aquifer by grouting in a coal mine area after mining based on a hole with multiple uses according to claim 1, wherein, there are a plurality of survey holes drilled from the ground area; wherein, a depth difference between two target layers corresponding to two adjacent survey holes is less than 20 m; and before determining a water retention level based on the water level before grouting and the water level after grouting, the method further comprises: completing grouting for all the grouting holes.

* * * * *